US007234954B1

(12) United States Patent
Srage et al.

(10) Patent No.: US 7,234,954 B1
(45) Date of Patent: Jun. 26, 2007

(54) INTERNATIONAL ELECTRICAL RECEPTACLE

(76) Inventors: Jay M. Srage, 6121 Park Meadow La., Plano, TX (US) 75093; Hisham A. Ramadan, 6121 Park Meadow La., Plano, TX (US) 75093

( * ) Notice: Subject to any disclaimer, the term of this patent is extended or adjusted under 35 U.S.C. 154(b) by 0 days.

(21) Appl. No.: 11/421,730

(22) Filed: Jun. 1, 2006

(51) Int. Cl.
*H01R 27/00* (2006.01)

(52) U.S. Cl. ..... 439/222; 439/173; 439/536; 439/107

(58) Field of Classification Search ..... 439/222, 439/223, 217, 116, 518, 173, 107, 536, 956, 439/166
See application file for complete search history.

(56) References Cited

U.S. PATENT DOCUMENTS 5,266,039 A * 11/1993 Boyer et al. ..... 439/107
5,898,130 A * 4/1999 Tansi et al. ..... 174/66
5,919,060 A * 7/1999 Lee ..... 439/518
5,938,459 A * 8/1999 Lee et al. ..... 439/172
6,010,347 A * 1/2000 Lee ..... 439/222
6,994,592 B1 2/2006 Gannon

* cited by examiner

*Primary Examiner*—Tho D. Ta
*Assistant Examiner*—Vanessa Girardi
(74) *Attorney, Agent, or Firm*—Schmeiser, Olsen & Watts LLP

(57) ABSTRACT

An electrical receptacle is disclosed, which is configured to fit and mount into an outlet box and has a front panel configured to receive different internationally standardized plug pin arrangements.

18 Claims, 8 Drawing Sheets

INTERNATIONAL ELECTRICAL RECEPTACLE

TECHNICAL FIELD

The present invention relates to an electrical receptacle capable of receiving different internationally standardized plug pin arrangements.

BACKGROUND OF THE INVENTION

International travelers are facing the problem of non-compatible electrical plugs and receptacles. A user of an electric appliance often visits a country, which adopts different plug configuration from the country where the appliance was initially purchased. Usually, the traveler resorts to using an adaptor plug to allow fitting the appliance's plug into the new country's wall receptacles.

In case a suitable adaptor is available, the use of an adaptor adds more contact points to the power link and protrudes further from the wall socket causing its contacts to get looser and making it more susceptible for tripping. Further, many of the adaptors receive plugs from a particular country only and therefore at many occasions the user needs to use a plurality of adapters attached to each other to obtain appropriate plug pin for his appliance. This results in a chain of adapters protruding out from the wall socket having a very loose contact with each other, thereby increasing the probability of tripping.

In the United States, the standards for electrical installation is the National Electrical Code® (NEC®) which is based on NFPA-70 published by the National Fire Protection Association. Accordingly, all wiring methods and material are standardized in compliance with NEMA (National Electrical Manufacturers Association) and UL (Underwriters Laboratories Inc.) standards.

Various attempts have been made in the past to overcome the problem faced by international travelers in fitting their appliances in the wall receptacle. However, the focus has been on use of adaptors such as the adaptor disclosed in U.S. Pat. No. 6,994,592 issued to GANNON.

U.S. Pat. No. 6,010,347 for "Universal electric socket" issued to Lee discloses another such arrangement. In Lee '347, a universal electric socket is provided for test purpose which can be used with different electric plugs. However, the arrangement focuses on prohibiting a high voltage short circuit between the positive terminal and the negative terminal and does not overcome the problem of fitting different appliances having different plug pin arrangements in the wall receptacle.

The problem to be solved is to allow fitting of different appliances having different plug pin arrangements in a wall receptacle and the problem is solved by providing an electrical receptacle configured to fit and mount into an outlet box and having a front panel configured to receive different internationally standardized plug pin arrangements.

DISCLOSURE OF THE INVENTION

According to an embodiment of the invention, an electrical receptacle is provided, which is configured to fit and mount into an outlet box, wherein the receptacle comprises a face body having a front panel configured to receive different internationally standardized plug pin arrangements, and a back panel with a groove to receive mounting screws; a back body having a first chamber with a bottom opening and a second and third chamber on each side of the first chamber, the back body forming a casing together with the face body; a first grounding frame adapted to receive and provide contacts with grounding pins of said different plug pin arrangements, placed from the bottom opening into the first chamber, having holes to receive mounting screws; two contact frames placed in the second and third chamber having screw terminal extending from each metal contact frame to serve as live contacts protruding from both sides of the back body and to connect to power supply hot and neutral conductors; a grounding strap mounted on and connected to the grounding frame and covering the bottom opening; and two mounting screws passing through the holes of the grounding frame to further penetrate through the back body and fasten to the groove at the back panel of the face body, thereby joining the grounding frame, the back body and the face body to form the receptacle.

According to another embodiment of the invention, the front panel of the face body of the receptacle is configured to receive different internationally standardized plug pin arrangements including:

IEE Group 1: European/International types (Types 11, 12, 13, 14, 15, 16 & 17)

IEE Group 2: USA types (Types 21, 22 & 23)

IEE Group 3: UK types (Types 31, 32 & 33)

IEE Group 4: Countries—European (Types 41, 42, 43 & 44)

IEE Group 5: Countries—other (Types 51, 52, 53 & 54)

According to another embodiment of the invention, the face body of the receptacle is wall-mounted.

According to another embodiment of the invention, the wall-mounted face body is sized in compliance with NEMA WD-6 configuration and dimensions for "Flush mount rectangular face devices receptacle", thus allowing the face panel to be covered with standard trade size wall plate for rectangular devices.

According to another embodiment of the invention, the contact frames of the electrical receptacle are made of metal.

According to another embodiment of the invention, the contact frames of the electrical receptacle are designed with conductive contact strips arranged to firmly clip with and provide electrical continuity for hot and neutral connection of different plug pin arrangements.

According to another embodiment of the invention, the first grounding frame of the receptacle is provided with metal flanges arranged to firmly clip with and provide electrical continuity to the grounding pins of the different plug pin arrangements.

According to another embodiment of the invention, the grounding strap of the receptacle is provided with fixation yokes at both ends to fix the receptacle into an outlet box.

According to another embodiment of the invention, the fixation yokes are sized in compliance with NEMA WD-6 configuration and sizing for "Yoke dimension of receptacles for box mounting".

According to another embodiment of the invention, the receptacle is configured to safely operate at rated voltage of 250 Volts or less.

According to another embodiment of the invention, the receptacle is configured to safely operate at rated amperage of 20 Amps or less.

According to another embodiment of the invention, the outlet box is an American trade size outlet box.

According to another embodiment of the invention, the fixation yokes are adapted to firmly fix the device into standard trade outlet boxes compliant with NEMA and UL requirements.

According to yet another embodiment of the invention, the front panel is configured to receive a plurality of different internationally standardized plug pin arrangements; the back body further comprises a fourth chamber with a bottom opening and a fifth and sixth chamber on each side of the fourth chamber; a second grounding frame identical to the first grounding frame is provided and is placed from the bottom opening into the fourth chamber; two additional contact frames are placed in the fifth and sixth chamber, the frames being interconnected to the frames in second and third chamber respectively; and the grounding strap is elongated to mount on and interconnect both the first and second grounding frames, thereby providing a common ground for the grounding frames.

According to another embodiment of the invention, two additional mounting screws are provided, which pass through the holes of the second grounding frame to further penetrate through additional corresponding holes provided in the back body and fasten to an additional groove provided at the back panel of the face body, thereby joining the grounding frame, the back body and the face body to form the receptacle.

According to another embodiment of the invention, the face body and the back body are injection-molded from non conductive material and constructed subject to the related NEC®, UL and NEMA requirements According to another embodiment of the invention, the metal contact frames are manufactured from conductive material.

According to another embodiment of the invention, the grounding frame and the grounding strap are manufactured from conductive material.

According to another embodiment of the invention, the receptacle is sized in accordance with applicable standards to allow mounting into standard trade outlet boxes described in the NEC®.

According to another embodiment of the invention, the receptacle is configured to fit and mount into standard trade size outlet boxes depicted in NEC® and complying with NEMA and UL standards.

According to another embodiment of the present invention, the front face panel and the metal contacts should provide safe usage and allow for frequent and repetitive plug insertion cycles.

According to yet another embodiment of the present invention, the front panel of the receptacle is configured to receive a plurality of different internationally standardized plug pin arrangements; the back body further comprises one or more additional sets of three chambers, one chamber with a bottom opening and two chambers on each side of the chamber having the bottom opening; an additional grounding frame identical to the first grounding frame is provided for each chamber with bottom opening and is placed from the bottom opening into the respective chamber; two additional contact frames are placed in each set of two chambers on each side of the chamber having the bottom opening, the frames being interconnected to the frames in corresponding chambers of other sets of three chambers; and the grounding strap is elongated to mount on and interconnect all the grounding frames, thereby providing a common ground for the grounding frames.

According to yet another embodiment of the present invention, two additional mounting screws are provided for each additional grounding frame, which pass through the holes of the additional grounding frame to further penetrate through additional corresponding holes provided in the back body and fasten to an additional groove provided at the back panel of the face body for each additional grounding frame, thereby joining the grounding frame, the back body and the face body to form the receptacle.

DETAILED DESCRIPTION OF THE INVENTION

Figure 1:
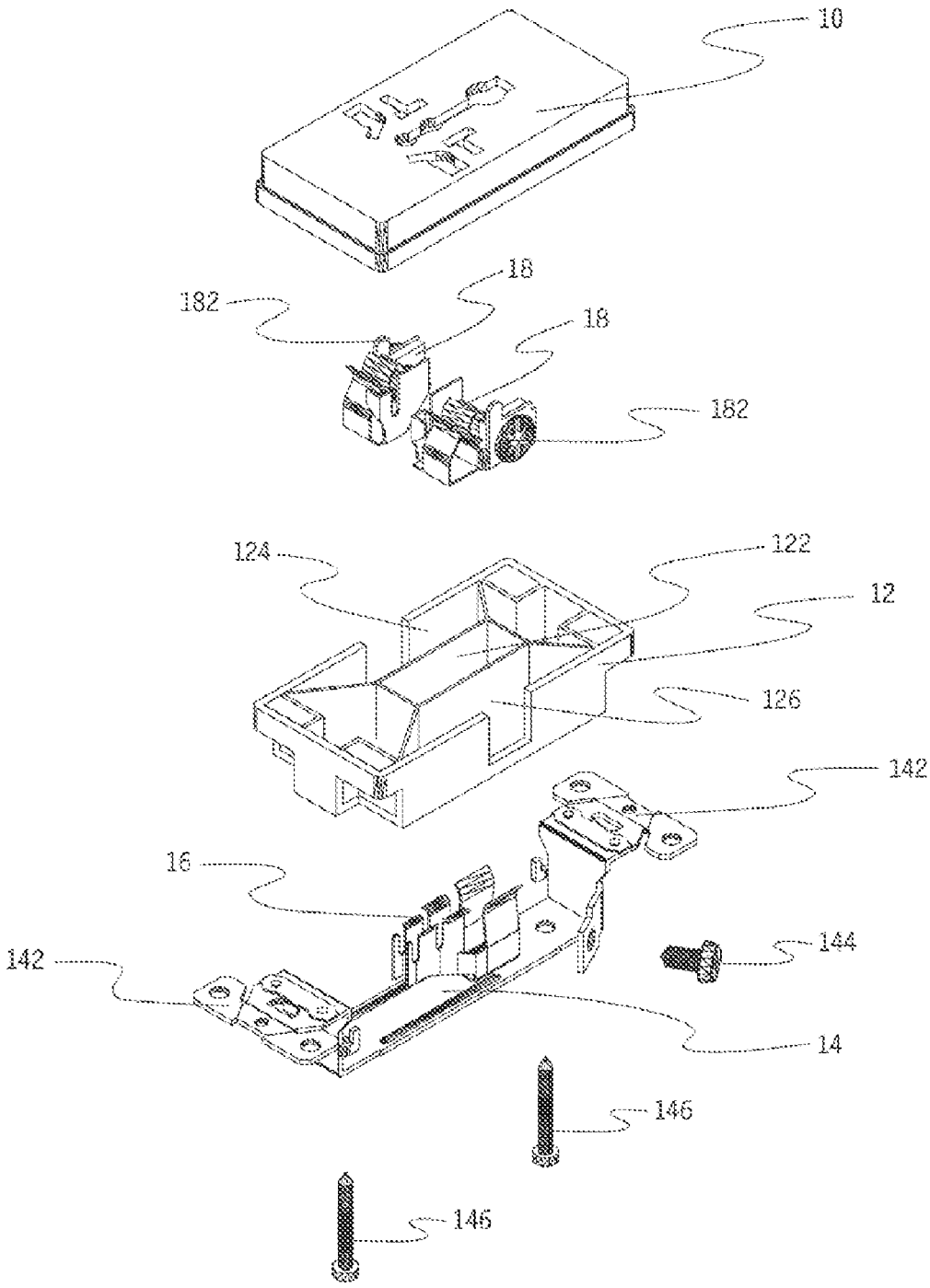
FIG. 1 is an exploded isometric view of an electrical receptacle, according to one embodiment of the present invention.

Referring to FIG. 1, an electrical receptacle is shown comprising of a face body 10 and a back body 12. Both the face body and back body are preferably injection-molded from non conductive material such as nylon or thermoplastic and constructed subject to the related NEC®, UL and NEMA requirements.

The face body 10 has a front panel which is the receptacle's front side and is designed to receive different internationally standardized plug pin arrangements including plug pins from appliances made within the United States, Great Britain and continental Europe among others. The face body further has a back panel having grooves 102 (FIG. 5) to receive mounting screws.

The metal contact frames 18 are respectively installed in the lateral receiving isolating chambers inside the back body 12. The back body comprises a first chamber 122 with a bottom opening and a second chamber 124 and third chamber 126 on each side of the first chamber. The two metal contact frames 18 are identical, preferably manufactured from conductive material, and installed in parallel mirror to each other to connect with both the hot and neutral power plug pins. The metal contact frames 18 are preferably designed with conductive contact strips arranged to firmly clip to different internationally standardized plug pin arrangements.

The screw terminals 182, extending from metal contact frames 18, are the live contacts protruding from both sides of the back body 12. The screw terminal 182 will connect to power supply hot and neutral conductors.

The grounding frame 16 is fixed on the grounding strap 14. Both the grounding frame 16 and the grounding strap 14 are preferably manufactured from conductive material such as copper.

The grounding frame 16 is adapted to receive and provide contacts 162 with grounding pins for external plugs having different plug pin arrangements. The grounding frame 16 fits into an opening in the bottom of the back body 12. This opening will be covered from the back by the grounding strap 14 and isolated from metal contact frames 18 through isolation chambers.

The grounding strap 14 joins the back body 12 and the face body 10 into one device. Protruding on both sides of the grounding strap 14 are the fixation yokes 142 for the receptacle. The fixation yokes 142 and respective openings are in compliance with NEMA WD-6 configuration and dimensions. The hole opening in the fixation yoke 142 will allow installing and fastening the receptacle on standard trade outlet boxes.

The two back assembling screws 146 will go through the holes of the grounding strap 14 and the holes of the back body 12. to fix into the grooves located at the back of the face body 10. These two assembling screws will group all the parts of the electrical receptacles into one coherent device.

A grounding terminal 144 is screwed to the grounding frame 14 and connects a grounding conductor coming in from the outlet box with the grounding frame 14 to provide electric continuity between the receptacle and the system equipment grounding.

Figure 2:
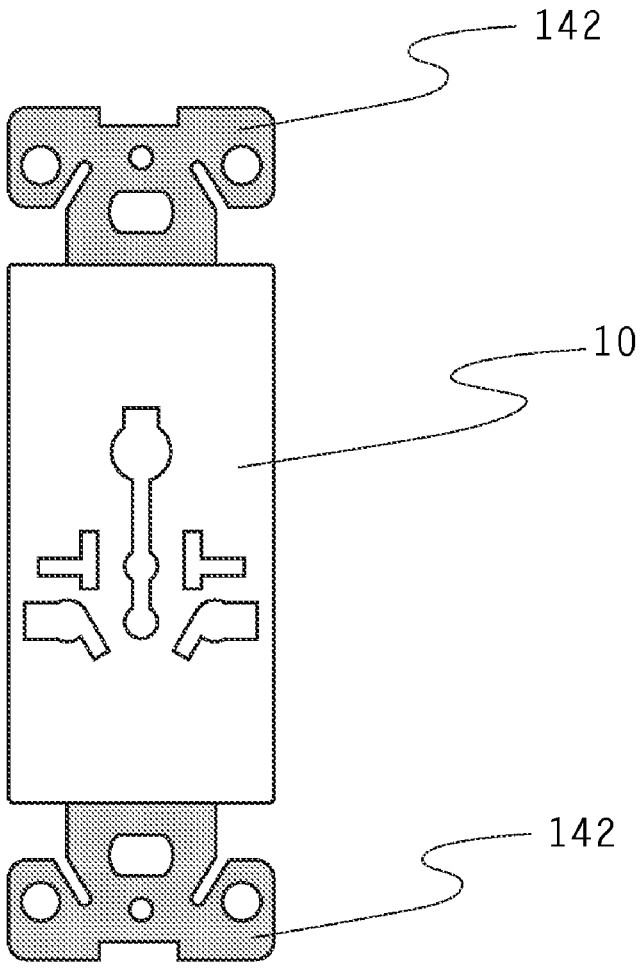
FIG. 2 is an assembly top view of the receptacle shown in FIG. 1.
Figure 3:
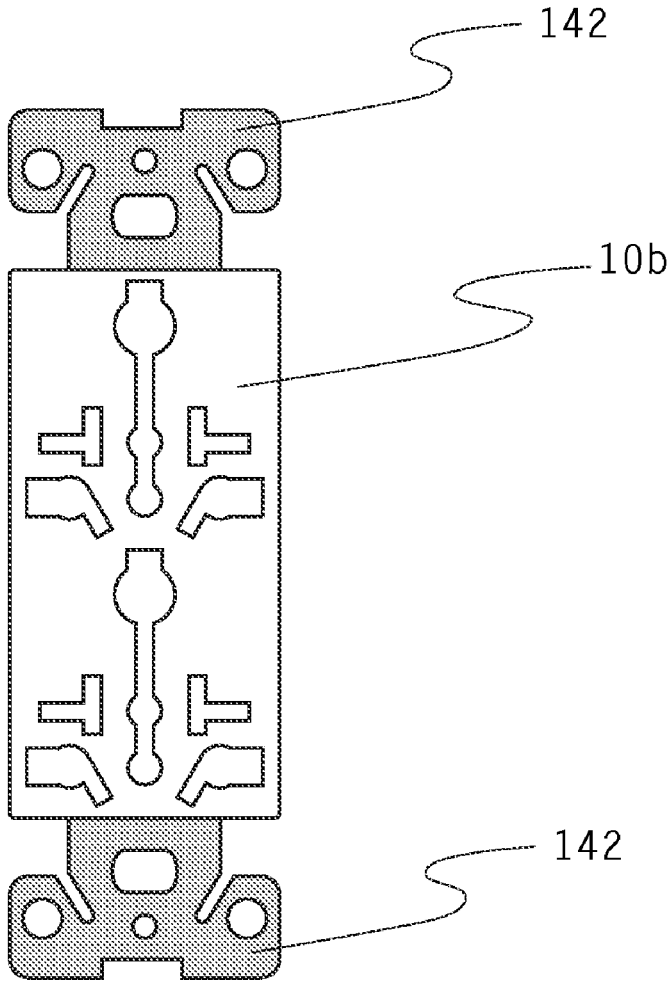
FIG. 3 is an assembly top view of an electric receptacle, according to another embodiment of the present invention.

Referring to FIG. 2 and FIG. 3, the face body is depicted respectively in two configurations 10 and 10*b*; either a simplex or a duplex receptacle.

The face body 10*b* of a duplex receptacle will accommodate simultaneously two electrical plugs. The back body will house two double metal contact frames within the lateral receiving isolating chambers. Each of the double metal contact frames will be formed to two interconnected metal contact frames 18. Two grounding frames 16 will be fixed on the grounding strap 14. The two grounding frames 16 will be interconnected via the grounding strap 14 to provide common ground for the grounding plug pin.

Figure 4:
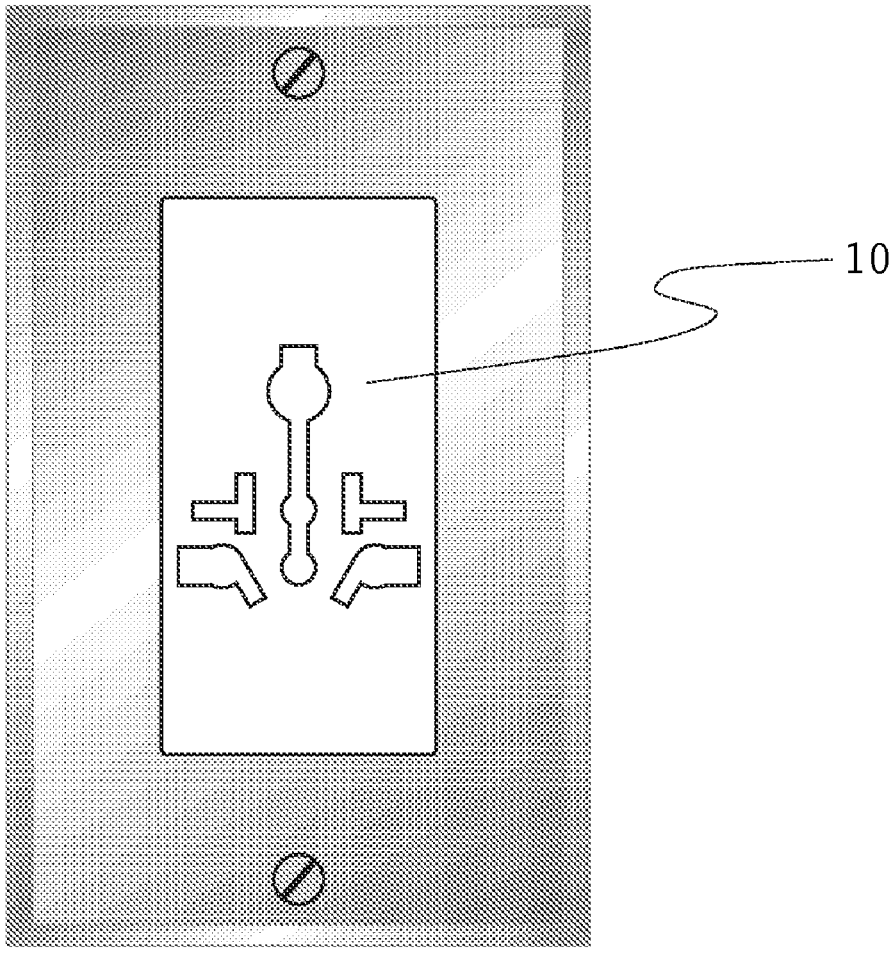
FIG. 4 is an assembly top view of the receptacle shown in FIG. 1 with decorator wall covering plate in place.

FIG. 4 illustrates the front view of a wall mounted receptacle with a decorator wall covering plate in place. The covering plate is fixed to fixation yokes 142 via screws.

Figure 5:
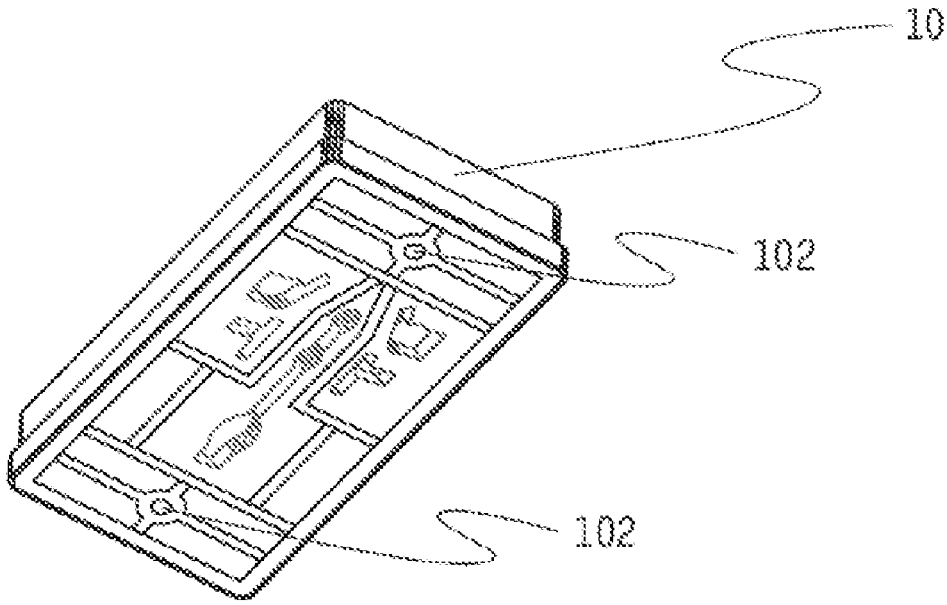
FIG. 5 is a detailed view of the back panel of face body of the receptacle shown in FIG. 1.

FIG. 5 shows the back panel of the face body 10 having grooves 102 to receive mounting screws 146.

Figure 6:
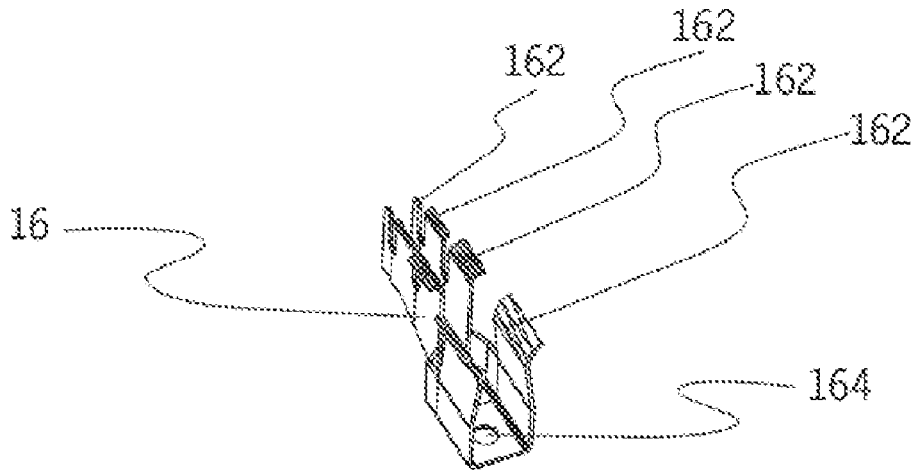
FIG. 6 is a detailed view of the grounding frame shown in FIG. 1.

FIG. 6 shows the grounding frame 16, the metal flanges 162 serving as contacts for grounding pins to firmly clip with and provide electrical continuity to the grounding pins of external plugs with different plug pin arrangements. The fixation point 164 serves as a mechanical and electrical point for the grounding frame 16 to the grounding strap 14.

Figure 7:
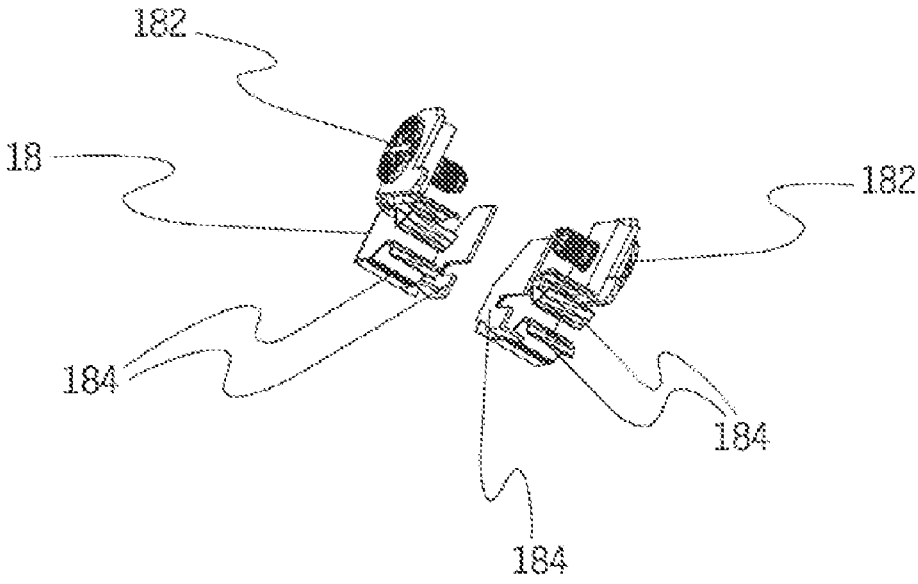
FIG. 7 is a detailed view of the metal contact frames shown in FIG. 1.

FIG. 7 shows the metal contact frames 18, the screw terminals 182 extending from metal contact frames 18 and contact strips 184 provided to clip with and provide electrical continuity for hot and neutral connection of different plug pin arrangements.

Figure 8:
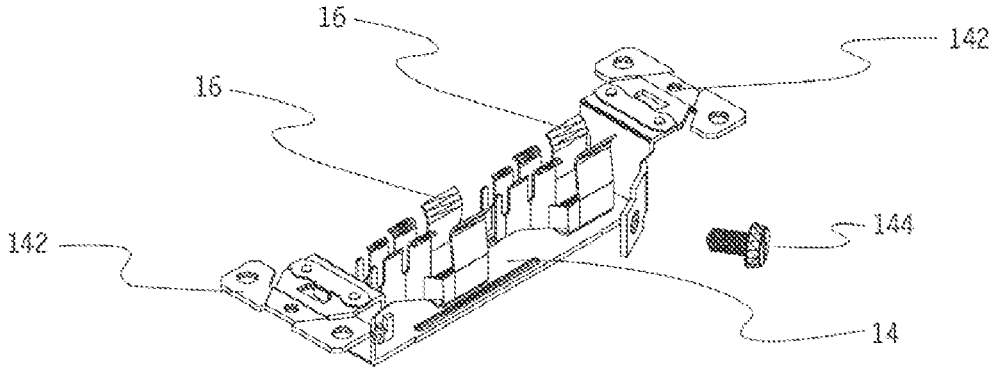
FIG. 8 is a detailed view of two grounding frames of the embodiment shown in FIG. 3.

FIG. 8 shows two grounding frames 16 fixed on the grounding strap 14. The two grounding frames 16 are interconnected via the grounding strap 14 to provide common ground for the grounding pins of external plugs.

It is to be understood that the drawings are designed for purposes of illustration only, and are not intended for use as a definition of the limits and scope of the invention disclosed. For example, the receptacle may be adapted to include other variations or added protection which might include: Ground-Fault Circuit Interrupter (GFCI) protection for personnel; Transient Voltage Surge Suppressor (TVSS), or an Isolated Ground (IG).

Further variations may be include but are not limited to a Hospital Grade product, increase in Amperage rating, color variation, tamper resistant shutter, status signaling among others.

What is claimed is:

1. An electrical receptacle configured to fit and mount into an outlet box comprising:

a face body having:

a front panel configured to receive different internationally standardized plug pin arrangements, and a back panel with a groove to receive mounting screws;

a back body having a first chamber with a bottom opening and a second and third chamber on each side of the first chamber, the back body forming a casing together with the face body;

a first grounding frame adapted to receive and provide contacts with grounding pins of said different plug pin arrangements, placed from the bottom opening into the first chamber, having holes to receive mounting screws;

two contact frames placed in the second and third chamber having screw terminal extending from each metal contact frame to serve as live contacts protruding from both sides of the back body and to connect to power supply hot and neutral conductors;

a grounding strap mounted on and connected to the grounding frame and covering the bottom opening; and two mounting screws passing through the holes of the grounding frame to further penetrate through the back body and fasten to the groove at the back panel of the face body, thereby joining the grounding frame, the back body and the face body to form the receptacle.

2. The electrical receptacle of claim 1, wherein the face body is wall-mounted.

3. The electrical receptacle of claim 1, wherein the first grounding frame is provided with metal flanges arranged to firmly clip with and provide electrical continuity to the grounding pins of said different plug pin arrangements.

4. The electrical receptacle of claim 1, wherein the receptacle is configured to safely operate at rated voltage of 250 Volts or less.

5. The electrical receptacle of claim 1, wherein the receptacle is configured to safely operate at rated amperage of 20 Amps or less.

6. The electrical receptacle of claim 1, wherein the outlet box is an American trade size outlet box.

7. The electrical receptacle of claim 1, wherein:

the front panel is configured to receive a plurality of different internationally standardized plug pin arrangements; and a second grounding frame is fixed on the grounding strap which interconnects the two grounding frames to provide common ground to receive the grounding pins.

8. The electrical receptacle of claim 1, wherein the face body and the back body are injection-molded from non conductive material and constructed subject to the related U.S. National Electrical Code, UL and NEMA requirements.

9. The electrical receptacle of claim 1, wherein the grounding frame and the grounding strap are manufactured from conductive material.

10. The electrical receptacle of claim 1, wherein the receptacle is sized in accordance with applicable standards to allow mounting into standard trade outlet boxes described in the U.S. National Electrical Code.

11. The electrical receptacle of claim 1, wherein the receptacle is configured to fit and mount into standard trade size outlet boxes depicted in U.S. National Electrical Code and complying with NEMA and UL standards.

12. The electrical receptacle of claim 1, wherein different internationally standardized plug pin arrangements include:

IEE Group 1: European/International types (Types 11, 12, 13, 14, 15, 16 & 17)

IEE Group 2: USA types (Types 21, 22 & 23)

IEE Group 3: UK types (Types 31, 32 & 33)

IEE Group 4: Countries—European (Types 41, 42, 43 & 44)

IEE Group 5: Countries—other (Types 51, 52, 53 & 54).

13. The electrical receptacle of claim 12, wherein the face body is sized in compliance with NEMA WD-6 configuration and dimensions for "Flush mount rectangular face devices receptacle", thereby covered with standard trade size wall plate for rectangular devices.

14. The electrical receptacle of claim 1, wherein the contact frames are made of metal.

15. The electrical receptacle of claim 14, wherein the contact frames are designed with conductive contact strips arranged to firmly clip with and provide electrical continuity for hot and neutral connection of different plug pin arrangements.

16. The electrical receptacle of claim 1, wherein the grounding strap is provided with fixation yokes at both ends to fix the receptacle into an outlet box.

17. The electrical receptacle of claim 16, wherein the fixation yokes are sized in compliance with NEMA WD-6 configuration and sizing for "Yoke dimension of receptacles for box mounting".

18. The electrical receptacle of claim 16, wherein the fixation yokes fix the receptacle into standard trade outlet boxes compliant with NEMA and UL requirements.

* * * * *